United States Patent [19]

Cornelissens et al.

[11] Patent Number: 4,622,161

[45] Date of Patent: Nov. 11, 1986

[54] DOSING UNIT COMPRISING A DETERGENT AND/OR A BLEACHING AGENT

[75] Inventors: Emery G. P. Cornelissens, Nootdorp; Jurjen P. Hofland, Zevenaar; Lambertus C. Mets, Arnhem, all of Netherlands

[73] Assignee: Akzo N.V., Arnhem, Netherlands

[21] Appl. No.: 807,214

[22] Filed: Dec. 12, 1985

Related U.S. Application Data

[63] Continuation of Ser. No. 656,889, Oct. 2, 1984, abandoned.

[30] Foreign Application Priority Data

Oct. 3, 1983 [NL] Netherlands ..... 8303380

[51] Int. Cl.[4] ..... C11D 17/04

[52] U.S. Cl. ..... 252/90; 252/92; 252/174; 206/0.5

[58] Field of Search ..... 252/90, 92, 174; 525/186; 206/0.5

[56] References Cited

U.S. PATENT DOCUMENTS

| | | | |
|---|---|---|---|
| 2,985,609 | 5/1961 | Plitt | 260/29.6 |
| 3,028,351 | 4/1962 | Plitt | 260/29.6 |
| 3,249,572 | 5/1966 | Davis et al. | 525/57 |
| 3,322,674 | 5/1967 | Friedman | 252/90 |
| 4,188,304 | 2/1980 | Clarke et al. | 252/93 |
| 4,234,442 | 11/1980 | Cornelissens | 252/90 |
| 4,397,391 | 8/1983 | Cornelissens et al. | 206/526 |

FOREIGN PATENT DOCUMENTS

| | | |
|---|---|---|
| 0011968 | 6/1980 | European Pat. Off. . |
| 2000177 | 1/1979 | United Kingdom . |
| 1583082 | 1/1981 | United Kingdom . |

*Primary Examiner*—Paul Lieberman
*Assistant Examiner*—Hoa Van Le
*Attorney, Agent, or Firm*—Parkhurst & Oliff

[57] ABSTRACT

Dosing unit comprising a detergent and/or a bleaching agent contained in a sachet which entirely or partly consists of a sealable substrate and is provided with one or more seams that are sealed with a water-sensitive coating composition.

The moment at which the sachet opens is to a great extent independent of the agitation and heating up behaviour of the (dish)washing machine. This is attained by using a coating composition comprising an anionic and/or a nonionic water binding polymer and a cationic polymeric adhesive.

13 Claims, No Drawings

DOSING UNIT COMPRISING A DETERGENT AND/OR A BLEACHING AGENT

This is a continuation of application Ser. No. 656,889 filed Oct. 2, 1984 now abandoned.

The present invention relates to a dosing unit comprising a detergent and/or a bleaching agent contained in a sachet which entirely or partly consists of a sealable substrate and is provided with one or more seams that are sealed with a water-sensitive coating composition. A dosing unit of the type indicated above is known from U.S. Pat. No. 2,760,942, GB No. 1 583 082 and BE No. 868 474.

U.S. Pat. No. 2,760,942 describes a detergent sachet of cellophane provided with seams sealed with an adhesive consisting of dextrose, urea and polyvinyl alcohol. GB No. 1 583 082 discloses a detergent sachet of which the seams are sealed with water-soluble adhesives such as polysaccharides, synthetic polymers such as polyvinyl alcohol or alkali metal silicates. BE No. 868 474 describes detergent sachets of which the seams are sealed with a material which disintegrates in water at a temperature of 40° to 60° C. As adhesive BE No. 868 474 recommends a mixture of polyethylene glycol and one or more thermoplastic acrylic resins.

When these well-known sachets are used in (dish)washing machines, the adhesive will after some time disintegrate upon its contact with water. As a result, the seams provided with the adhesive will open and the sachet will discharge its contents. The moment these sachets open will also depend on the temperature of the water in the (dish)washing machine and the mechanical forces applied to the sachets by the agitation in the (dish)washing machine. Since the commercially available (dish)washing machines display varying agitation and heating up behaviour, the specific moment the same type of sachet will open in the various types of (dish)washing machines also differs. As a result, it will not always be possible for a particular type of dosing unit to satisfactorily be used for a single purpose in all types of (dish)washing machines.

There is therefore a need for a dosing unit for which the moment the sachet opens is to a great extent independent of the agitation and heating up behaviour of the (dish)washing machine.

The present invention meets said need and is characterized as a dosing unit of the above-mentioned type wherein the coating composition comprises:

(a) an anionic and/or a nonionic water binding polymer and (b) a cationic polymeric adhesive.

It should be added that EP No. 0 001 500 describes sachets provided with seams that open as a result of mechanical forces applied to them by the washing machine. Consequently, the time after which one and the same sachet will open will clearly vary with the agitation and/or heating behaviour characteristic of the washing machine in which it is used.

The present dosing units offer many advantages over the traditional powdered detergents packaged in cartons or bags. The most important of which are:

(1) ease of dosage; over-dosage or underdosage of detergent and/or bleaching agent is practically excluded;

(2) no loss of detergent and/or bleaching agent in the dispenser of the (dish)washing machine;

(3) small loss of detergent and/or bleaching agent in the dead pockets of the drum of the washing machine;

(4) the construction of the sachet is less restrictive to the form of the detergent and/or bleach. For instance, the sachets may form convenient containers of pellets and extrudates, which may constitute a practical advantage.

The sachets should consist entirely or partially of a sealable substrate in order to enable the seams to be sealed (heat-sealed, pressure-sealed, etc.).

Examples of suitable polymers from which this sealable substrate may be built up include polyolefins, such as polyethylene, polypropylene and copolymers of ethylene and propylene; polystyrene, polyesters, polyvinyl acetate, polyvinyl acrylate, polyvinyl chloride, polyvinylidene chloride, polyamide, polyacrylonitrile, cellulose derivates such as cellophane. The sealable substrate also may consist of mixtures of these polymers. It is preferred that use should be made of polyethylene and polypropylene.

The sealable substrates may moreover be in the form of woven fabrics, knitted fabrics, bonded fabrics and non-woven webs.

The molecular weight of said polymers may vary within wide limits. The present coating comprises:

(a) an anionic and/or a nonionic water binding polymer, and (b) a cationic polymeric adhesive.

The term water binding as used herein comprises dissolving, swelling and/or disintegrating in water.

Examples of suitable anionic water binding polymers include polyacrylamide; carboxymethyl cellulose, dicarboxymethyl cellulose, carboxymethyl starch, copolymers of methylbutyl ether and maleic anhydride and acrylic and methacrylic polymers. Examples of nonionic water binding polymers include polyacrylamide (nonionic), polyethylene oxide, polyvinyl alcohol, copolymers of vinyl alcohol and vinyl acetate, polyvinyl pyrrolidone, copolymers of vinyl pyrrolidone and vinyl acetate, cellulose derivatives such as hydroxyethyl cellulose, hydroxypropyl cellulose, methyl cellulose, hydroxyethyl hydroxypropyl cellulose and cellulose acetate, starch derivatives, polysaccharine derivatives, polyvinylmethyl ether and copolymers of styrene and maleic anhydride. Optionally, of course, mixtures of the above-mentioned compounds may be used. It is preferred that use should be made of a nonionic, water binding polymer, more particularly polyvinyl alcohol and/or polyvinyl pyrrolidone, special preference being given to the latter compound. The adhesive is a cationic polymer.

The cationic polymer may be water-soluble, water-insoluble or capable of disintegrating in water.

Examples of suitable cationic polymeric adhesives include polyethylene imine homopolymers and copolymers of dimethyl diallyl ammonium chloride.

A preferred adhesive is polyethylene imine.

Polyethylene imine is a highly branched polyamine having an average molecular weight in the range of 300 to 2,000,000. Particularly suitable for the present purpose have been found polyethylene imines having average molecular weights of about 800, 1400, 600,000 and 1,800,000. Polyethylene imines having these molecular weights are commercially available under the trade marks Polymin G 20®, Polymin G 35®, Polymin P®, Polymin SN®, (of BASF). For the present use the average molecular weight is preferably in the range of 800 to 1,000,000.

The properties of the relatively low-molecular weight polyethylene imines are described in Handbook of Adhesives, I. Skeist van Nostrand Reinhold Comp., 2nd Ed., 1977, Chapter 36, pp. 592–596.

The coating generally contains 1 to 80, preferably 5 to 40 percent by weight of the polymeric adhesive and 20 to 99, preferably 60 to 95% by weight of the water binding polymer.

The coating also may contain, for instance, wetting agents such as polyethylene glycols and sulphosuccinates and plasticizers such as dibutyl phthalate and diisopropyl phthalate.

With the present invention, however, most preference is given to use of a coating comprising 5 to 40, more particularly 15 to 30 percent by weight of polyethylene imine and 60 to 95, more particularly 70 to 85 percent by weight of polyvinyl pyrrolidone.

Preparation of this coating and its application to the sachet material may be carried out as follows.

A 1 to 10% solution of polyvinyl pyrrolidone is prepared in a volatile organic solvent such as methanol.

Subsequently, this solution is mixed, with stirring, with a 30 to 70% aqueous solution of polyethylene imine. The final solution should contain 2 to 10 percent by weight of the coating. This solution may be applied to the sachet material by spraying, or with the aid of an applicator roll, a gravure cylinder or a spiral raker, the volatile solvent being removed by evaporation at the same time or afterwards.

It is preferred that before being coated the sachet material should be subjected to a corona treatment. In it the surface of the sachet material is exposed to an electric discharge, as a result of which its polarity and roughness will increase. This treatment results in homogeneous distribution of the coating and improved wetting behaviour of the sachet material.

The seam to be sealed may be coated on one of its insides or on both.

With a single rectangular sachet one or more seams may be provided with an adhesive. Preferably, however, only one of the seams is not provided with an adhesive, so that after sealing there is left one permanently closed seam and the sachet will not fall apart during use. This facilitates its removal after (dish)washing.

Sealing may be effected thermally, mechanically under pressure and/or ultrasonically. Preference is given to thermal sealing under pressure.

The opening time of the sachet (i.e. the time it takes for the sachet to open starting from the moment of commencing the washing process) may be set between wide limits and will generally range of from 2 to 20 minutes. The opening time will depend, inter alia on the physical properties of the substrate, the corona treatment, if used, the sealing method, the amount of coating composition per unit of surface area and the ratio between the water binder and the adhesive and the presence of in the coating of further additives, if any.

The opening times for the various uses may be set as a function of these factors.

It should be added that U.S. Pat. No. 2,985,609 and U.S. Pat. No. 3,028,351 describe pressure sensitive adhesives consisting of a mixture of a polyethylene imine and polyvinyl alcohol or polyvinyl pyrrolidone. The present use is not mentioned therein.

The present invention offers advantages particularly to multi-compartment sachets. These are generally used when detergent and/or bleach components are to be successively discharged from the sachet into the wash liquor. An example thereof is known from BE No. 868 474. The dosing unit described in it comprises a measured quantity of detergent contained in a sachet having two compartments. The detergent contains 5 to 30 percent by weight of one or more solid acids having a $pK_1$ value of 2.8 to 4.8 capable of forming water-soluble calcium salts and magnesium salts and/or complexes, at least 5 percent by weight of alkali carbonate and usual detergent constituents. The total amount of alkali is present in stoichiometric excess over the total amount of acid. Said acid(s) is(are) contained in a compartment whose contents are released practically immediately upon contact with the wash liquor. This is made possible for instance by using an acid compartment whose outer wall is water permeable and/or disintegrates in water. To that end the outer wall may partly or entirely be of a non-woven material.

The alkali substances are contained in the other compartment, which is provided with one or more seams that are sealed with a material which will after some time disintegrate in the wash liquor, after which the contents of this compartment are discharged. A preferred adhesive is a mixture of polyethylene glycol and thermoplastic arylic resins (=anionic polymers). This dosing unit, which has also found practical application, offers the possibility of large scale use of phosphate-free detergents. With this dosing unit the alkali constituents in the wash liquor should be released then after the mildly acid conditions have been maintained sufficiently long to permit almost complete dissolution of the carbonate precipitated in the preceding washing cycle. Although in actual practice favourable results are obtained with this dosing unit, the opening time of the sachet is dependent on the temperature of the wash liquor and the agitation behaviour of the washing machine. Therefore the opening time of the sachet will vary with the agitation behaviour of the washing machine.

For optimum washing results in all types of washing machines and with all washing programs (30° C., 40° C., 60° C. and 90° C. washing temperatures) it is desirable that under these varying conditions the opening times of one and the same particular type of sachet should differ only little. This means that the opening of the sachet should mainly be time-controlled, which can be realized with the present adhesive.

With the above-mentioned two-compartment sachet provided with one or more seams sealed with the present coating the opening time will generally be in the range of 2 to 20, preferably 4 to 18, and especially 6 to 12 minutes. It is preferred that these sachets should entirely or partially consist of a non-woven material such as paper in combination with polyethylene and/or propylene. It is preferred that the coating should consist of 5 to 40 percent by weight of polyethylene imine and 60 to 95 percent by weight of polyvinyl alcohol and/or polyvinyl pyrrolidone. Most preference is given to polyvinyl pyrrolidone as water binding polymer. The amount of coating applied to the sachet material is generally in the range of 0.1 to 10 $g/m^2$, preferably 0.1 to 2 $g/m^2$ and especially 0.2 to 0.7 $g/m^2$.

These sachets permit realization under widely different conditions of opening times which are all in the range of, say, 5 to 15 minutes.

For more particulars about the manufacture of these sachets reference is made to BE No. 868 474.

The dosing unit of the present invention also may be used for cleaning and decalcifying of dish washing machines, the practically immediately discharged contents of the one compartment of the dosing unit containing a strongly alkaline substance mixed with a foam inhibiting surfactant and the retardingly discharged contents of the other compartment containing a decalcifying acid.

The following examples serve to illustrate the invention.

EXAMPLE 1

A rectangular two-compartment sachet (13×15 cm) of the type described in BE No. 868 474 was made consisting of:

- a water-permeable, polyethylene-dusted (sintered) non-woven outer wall of the acid compartment;
- a water-impermeable, propylene dividing wall provided with a coating;
- a water-impermeable, polypropylene laminated (coated) non-woven outer wall of the alkali compartment.

The coating composition was made up of 22.2% of polyethylene imine having a molecular weight of 600 000 and 77.8% of polyvinyl pyrrolidone, having a molecular weight of 24,500.

On the side of the alkali compartment, the dividing wall was entirely covered with this coating composition, which had been applied in an amount of 0.3 g/m$^2$ with the aid of a gravure cylinder. The two side seams of the alkali compartment were non-permanently sealed (sealing temperature 110°-140° C., sealing pressure about 4 atmospheres, sealing time 0.5 seconds). All other seams were permanently sealed (sealing temperature 145° C./145° C., sealing pressure about 2 atmospheres, sealing time 0.5 seconds). The acid compartment was filled with 24 g of pellets made up of:

1 g of sodium dodecyl benzene sulphonate
6.2 g of adipic acid
6.2 g of succinic acid
10.6 g of glutaric acid.

The alkali compartment was filled with 106 g of powder made up of:

8 g of potassium tallow fat ether sulphate
5 g of potassium tallow fat ether sulphate
2 g of sodium salt of hardened rapeseed oil
10 g of sodium disilicate
44 g of anhydrous soda
30 g of sodium perborate
7 g of CMC, optical bleach, perfume, sodium EDTA.

Of these sachets the opening times were determined in washing machines displaying a widely differing agitation and heating behaviour. Use was made to that end of an Erres 401, an AEG Lavamat Domina 600E and a Miele Automatic W425 washing machine.

The Erres machine is a slowly agitating washer in which the wash liquor temperature rises relatively quickly. The AEG is a machine displaying a considerably higher agitation speed in which the wash liquor temperature rises relatively slowly. Of the machines used the Miele washer has the highest agitation intensity. The heating up time of the wash liquor is between that of the Erres machine and that of the AEG machine. The table below shows the average opening times of the above-described sachet measured in these 3 washing machines.

| Washing machine | Washing program | average opening time in minutes | number of tests | standard deviation in minutes | average opening temp. (°C.) |
|---|---|---|---|---|---|
| Erres 401 | 60° colour fast coloureds | 12;5 | 3 | 0;5 | 39 |
| AEG Lavamat Domina 600E | 30° main wash | 11;0 | 4 | 2;0 | 24 |
| Miele Aut. W 425 | 40° main wash | 11;3 | 3 | 2;0 | 34 |

EXAMPLE 2

Contrary to the procedure in Example 1 only one short side of the alkali compartment was permanently sealed; both the other short side and the side seams were sealed for 0.5 seconds with a coating composition at 110°-140° C. and 4 atmospheres. The coating composition consisted of 21.1% of polyethylene imine, 73.9% of polyvinyl pyrrolidone and 5% of polyethylene glycol 1000.

These sachets were used for determining the opening times in the Erres and in the AEG washing machines: see the table below.

| Washing machine | Washing program | average opening time in minutes | number of tests | standard deviation in minutes | average opening temp. (°C.) |
|---|---|---|---|---|---|
| Erres 401 | 60° colourfast coloureds | 9;7 | 37 | 2;1 | 37 |
| AEG Lavamat Domina 600E | 30° main wash | 7;6 | 37 | 1;5 | 24 |
| AEG Lavamat Domina 600E | 30° wash with relatively slow drum agitation | 8;8 | 10 | 2;0 | 26 |
| AEG Lavamat Domina 600E | cold main wash | 9;6 | 10 | 2;7 | 18 |

EXAMPLE 3

Contrary to Example 1 one short side of the alkali compartment was permanently sealed; both the other short side and the two side seams were sealed for 0.5 seconds with a coalting composition at 125°-140° C. and 3 atmospheres.

The coating composition consisted of 38.9% of polyvinyl pyrrolidone, 38.9% of E335 (poly 1-vinyl-2-pyrrolidone covinyl acetate from GAF with 25 mole % of vinyl pyrrolidone and 75 mole % of vinyl acetate) and 22.2% of polyethylene imine.

The opening times of the sachets were as follows:

| Washing machine | Washing program | average opening time in minutes | number of tests | standard deviation in minutes | average opening temp. (°C.) |
|---|---|---|---|---|---|
| AEG Lavamat Domina | 30° main wash | 7;3 | 10 | 0;9 | 25 |

-continued

| Washing machine | Washing program | average opening time in minutes | number of tests | standard deviation in minutes | average opening temp. (°C.) |
|---|---|---|---|---|---|
| 600E AEG Lavamat Domina 600E | 30° relatively slow drum agitation | 8;3 | 10 | 1;3 | 30 |

EXAMPLE 4

Contrary to Example 1 one short side of the alkali compartment was permanently sealed; both the other short side and the two side seams were sealed with a coating composition for 0.5 seconds at 100°-140° C. and 3 atmospheres. The coating composition consisted of 38.9% of polyvinyl pyrrolidone, 38.9% of E-735 (poly 1-vinyl-2-pyrrolidone-covinyl acetate from GAF with 64 mole % of vinyl pyrrolidone and 36 mole % of vinyl acetate) and 22.2% of polyethylene imine.

The other wall of the alkali compartment consisted of a polyethylene laminated (coated) non-woven material.

The opening times of the satchets were as follows:

| Washing machine | Washing program | average opening time in minutes | number of tests | standard deviation in minutes | average opening temp. (°C.) |
|---|---|---|---|---|---|
| AEG Lavamat Domina 600E | 30° main wash | 5;6 | 10 | 1;7 | 21 |
| AEG Lavamat Domina 600E | 30° wash with relatively slow drum agitation | 7;3 | 10 | 1;9 | 30 |

EXAMPLE 5

Contrary to Example 1 one short side of the alkali compartment was permanently sealed; both the other short side and the two side seams were sealed with a coating composition for 1 second at 120°-140° C. and 2.4 atmospheres. The coating composition consisted of 83.3% of Mowiol 26-88 (copolymer of vinyl alcohol and vinyl acetate from Hoechst) and 16.7% of polyethylene imine.

The coating was applied in an amount of 5.2g/m$^2$.

The opening times of the sachets were as follows:

| Washing machine | Washing program | average opening time in minutes | number of tests | standard deviation in minutes | average opening temp. (°C.) |
|---|---|---|---|---|---|
| AEG Lavamat Domina 600E | 30° main wash | 8;7 | 10 | 1;1 | 28 |
| AEG Lavamat Domina 600E | 30° relatively slow drum agitation | 8;8 | 10 | 1;9 | 28 |

EXAMPLE 6

Contrary to Example 1 one short side of the alkali compartment was permanently sealed; both the other side and the two side seams were sealed for 1 second at 120°-140° C. and 2.4 atmospheres.

The coating compositions consisted of 83.3% of Mowiol V 321 (polyvinyl alcohol from Hoechst) and 16.7% of polyethylene imine.

The coating was applied in an amount of 1.3 g/m$^2$.

The opening times of the satchets were as follows:

| Washing machine | Washing program | average opening time in minutes | number of tests | standard deviation in minutes | average opening temp. (°C.) |
|---|---|---|---|---|---|
| AEG Lavamat Domina 600E | 30° main wash | 6;6 | 10 | 0;7 | 23 |
| AEG Lavamat Domina 600E | 30° wash with relatively slow drum agitation | 7;6 | 10 | 1;4 | 29 |

EXAMPLE 7

Contrary to Example 1 one short side of the alkali compartment was permanently sealed; both the other side and the two side seams were sealed for 1 second at 101°-135° C. and 2.1 atmospheres.

The coating composition consisted of 15.3% of Merquat 550 (copolymer of dimethyl diallyl ammonium chloride and acrylamide from Chemviron), 81.5% of polyvinyl pyrrolidone, 3.2% of nonyl phenol 8 e.o. and 0.1% of NaOH. The coating was applied in an amount of 0.3 g/m$^2$.

The opening times of the sachets were as follows:

| Washing machine | Washing program | average opening time in minutes | number of test | standard deviation in minutes | average opening temp. (°C.) |
|---|---|---|---|---|---|
| AEG Lavamat Domina 600E | 30° main wash | 9;7 | 10 | 3;0 | 30 |
| AEG Lavamat Domina 600E | 30° wash with relatively slow drum agitation | 9;3 | 10 | 3;0 | 30 |

We claim:

1. A dosing unit comprising at least one compound selected from the group consisting of detergents and bleaching agents, a satchet comprising a sealable substrate provided with one or more seams sealed with a water sensitive coating composition, wherein the coating composition comprises 60 to 95 percent by weight polyvinyl pyrrolidone and 5 to 40 percent by weight polyethylene imine respectively and wherein said one or more seams will open upon contact with an aqueous solution for between 2 and 20 minutes.

2. A dosing unit according to claim 1, wherein the sealable substrate comprises at least one of polyethylene and polypropylene.

3. A dosing unit according to claim 1, wherein the sachet has two compartments, one compartment comprising a material selected from the group consisting of substances which are permeable to water and substances which immediately disintegrate in water, and the other compartment being formed of a material which is impermeable to water and will not disintegrate therein and is provided with one or more seams sealed with the coating composition.

4. A dosing unit comprising:

at least one compound selected from the group consisting of detergents and bleaching agents;

a multi-compartment sachet containing said compound and comprising a sealable substrate having at least one seam sealed with a water sensitive coating composition;

wherein said coating composition comprises 60 to 95 percent by weight polyvinyl pyrrolidone and 5 to 40 percent by weight polyethylene imine respectively; and wherein said at least one seam will open upon contact with an aqueous solution for between 2 and 20 minutes.

5. A dosing unit according to claim 4, wherein the sealable substrate comprises at least one of polyethylene and polypropylene.

6. A dosing unit according to claim 4, wherein said multi-compartment sachet has two compartments, the first compartment having an outer wall comprising a material selected from the group consisting of substances which are permeable to water and substances which immediately disintegrate in water, the second compartment having an outer wall formed of a material which is impermeable to water and will not disintegrate therein, and a water impermeable partition wall separating the two compartments, wherein at least one seam of the second compartment is coated with said water sensitive composition.

7. A dosing unit according to claim 6, wherein the said outer wall of said first compartment comprises polyethylene.

8. A dosing unit according to claim 6, wherein the said outer wall of said second compartment comprises polypropylene.

9. A dosing unit according to claim 6, wherein the said partition wall comprises propylene.

10. A dosing unit according to claim 4, wherein one of the multi-compartments contains an alkaline detergent constituent and another of the multi-compartments contains an acidic detergent constituent.

11. A dosing unit according to claim 4, wherein at least one said seam will open between 4 and 18 minutes.

12. A dosing unit according to claim 4, wherein at least one said seam will open between 6 and 12 minutes.

13. A dosing unit comprising:

a compound selected from the group consisting of detergents and bleaching agents;

a multi-compartment sachet containing said compound and comprising a sealable substrate having at least one seam sealed with a water sensitive composition;

wherein said coating composition comprises 60 to 95 percent by weight of polyvinyl pyrrolidone and 5 to 40 percent by weight polyethylene imine respectively; and wherein at least one said seam will open upon contact with an aqueous solution for between 6 and 12 minutes.

* * * * *

UNITED STATES PATENT AND TRADEMARK OFFICE

CERTIFICATE OF CORRECTION

PATENT NO. : 4,622,161

DATED : November 11, 1986

INVENTOR(S) : Emery G. P. CORNELISSENS et al

It is certified that error appears in the above-identified patent and that said Letters Patent is hereby corrected as shown below:

Column 6, Example 1, in the table, every occurrence change ";" to --.--.

Column 6, Example 2, in the table, every occurrence change ";" to --.--.

Column 6, Example 3, in the table, every occurrence change ";" to --.--.

Column 7, Example 3, in the table, every occurrence change ";" to --.--.

Column 7, Example 4, in the table, every occurrence change ";" to --.--.

Column 7, Example 5, in the table, every occurrence change ";" to --.--.

Column 8, Example 6, in the table, every occurrence change ";" to --.--.

Column 8, Example 7, in the table, every occurrence change ";" to --.--.

Column 8, line 52, change "satchet" to --sachet--.

Column 10, line 25, before "composition;" insert --coating--.

Signed and Sealed this

Seventeenth Day of February, 1987

*Attest:*

DONALD J. QUIGG

*Attesting Officer* *Commissioner of Patents and Trademarks*